United States Patent [19]

Yamada et al.

[11] 4,069,677

[45] Jan. 24, 1978

[54] ANCHOR AND METHOD FOR CONSTRUCTING SAME

[75] Inventors: Kunimitsu Yamada, Tokyo; Hitaka Kanematsu, Komae, both of Japan

[73] Assignee: Kabushiki Kaisha Nitto Tekuno Group, Tokyo, Japan

[21] Appl. No.: 696,480

[22] Filed: June 16, 1976

[30] Foreign Application Priority Data

June 20, 1975 Japan ..... 50-76247
Dec. 24, 1975 Japan ..... 50-155503

[51] Int. Cl.[2] ..... E02D 5/74

[52] U.S. Cl. ..... 61/39; 61/53.52; 52/166; 52/230

[58] Field of Search ..... 61/39, 35, 53.52, 45 B; 52/166, 165, 169, 223, 230; 24/114.5, 115 P; 403/374, 369

[56] References Cited

U.S. PATENT DOCUMENTS

| | | | |
|---|---|---|---|
| 3,422,501 | 1/1969 | Yoshimura | 403/374 X |
| 3,641,772 | 2/1972 | Dietrich | 61/35 |
| 3,735,541 | 5/1973 | Vanderlinde | 61/35 |
| 3,899,892 | 8/1975 | Yokota | 61/39 |
| 3,936,924 | 2/1976 | Ichise | 52/166 |
| 3,971,177 | 7/1976 | Endo | 61/39 |

*Primary Examiner*—Jacob Shapiro
*Attorney, Agent, or Firm*—Meyer, Tilberry & Body

[57] ABSTRACT

An earth anchor includes a steel tension member, or members, sheath encased and embedded in a hardenable material such as mortar grout poured in a bore hole prepared in the ground. Lubricant is applied to the surfaces of the steel tension members before the members are placed within the interior sheaths. Gripping metal pieces are secured to the end portions of the steel tension members in abutment with a pressure bearing plate or plates, also secured to the end portions of the steel tension members. The gripping metal pieces are designed to be sripped from the steel tension end portion member with a force exceeding the predetermined work load of the steel tension members.

12 Claims, 13 Drawing Figures

ANCHOR AND METHOD FOR CONSTRUCTING SAME

The Prior Art

This invention relates to earth anchors and a method for constructing the same for use in supporting earth retaining walls consisting of sheet piles and the like. More particularly, the invention relates to land anchors and a method of construction in which a steel tension member, or members, sometimes referred to as reinforcing rods, are embedded in a hardenable material which forms an anchor body when hardened, with a pressure bearing plate secured to the interior end portions of the steel tension members.

In general, prior art earth anchors are embedded in earth bored holes to facilitate earth reinforcement and support in and around building and construction sites. However, it is often necessary to remove these anchors after they have served their purpose. The anchor bodies consisting of hardened material, such as mortar or concrete, may be readily broken, but steel reinforcing rods are quite difficult to sever and remove.

One solution to the reinforcing rod extraction problem is taught in the U.S. Pat. No. 3,936,924 wherein the anchor reinforcing rods are pre-coated with thermoplastic resin. When the rods are to be removed the thermoplastic resin is heated and fused by means of an electric heater. This fusion breaks the bond between the rods and the concrete thereby enabling the rods to be withdrawn from the body of the anchor with greater ease.

In the U.S. Pat. No. 3,899,892, there is disclosed an anchor which may be removed by preparing a plurality of reinforcing rods which have been bundled with bands. A friction-reducing agent such as grease is applied to the surfaces of some, but not all, of the reinforcing rods which may therefore be easily withdrawn. Withdrawal of the greased rods reduces the binding forces on the remaining reinforcing rods, enabling them also to be more readily withdrawn. However, with this prior art anchor, if a greater retaining wall supporting force is required, the length of the anchor must be increased because its maximum permissible load is a function of the linear bond between the reinforcing rods and the concrete anchor body.

In order to avoid the necessity of increasing the length of land anchors proportional to increased load, it has been proposed that a disc or supporting plate having a diameter smaller than the diameter of an earth bore is secured to the interior end portions of reinforcing rod members. With this arrangement the supporting plate will function to transfer load from the reinforcing rods to the anchor body thereby avoiding the problem of failure in shear between the rods and the anchor body.

However, it is exceedingly difficult if not a practical impossibility to remove the reinforcing rods from the anchor body because the supporting plate has been rigidly embedded in the anchor body.

OBJECTS OF THE INVENTION

It is accordingly, a primary object of the present invention to provide an earth anchor and a method of construction in which steel tension members securing a pressure bearing plate thereto may be readily removed from the body of an anchor after its intended use.

It is another object of the present invention to provide an earth anchor and a method for constructing same, in which steel tension members may be readily removed from the body of the anchor by maintaining steel tension members embedded in but unbonded to the anchor body.

It is a further object of the present invention to provide an earth anchor and a method for constructing same, in which, during the service of an anchor, a pressure bearing plate is positively secured to the interior ends of steel tension members, so that a supporting force to be borne by the steel tension members may be transferred by the medium of the pressure bearing plate to a body of an anchor.

It is a further object of the invention to provide an earth anchor in which steel tension members are secured to a pressure bearing plate by means of disengageable sleeves pressure fitted on the interior ends of the steel tension members.

It is a further object of the invention to provide an earth anchor in which the steel tension members are removable upon application of a force thereto in excess of the intended load bearing capability of the steel tension members.

It is a further object of the present invention to provide an economical anchor, in which a plurality of pressure bearing plates are each secured to the respective interior end of a corresponding steel tension member to provide uniform transmission of a supporting load to an anchor body, while permitting withdrawal of each of said steel tension members with a force smaller than the total supporting force.

It is a still further object of the present invention to provide an anchor having a single pressure bearing plate secured to the interior ends of a plurality of steel tension members wherein the pressure bearing plate and each steel tension member may be disengaged from each other with a force less than the load bearing capacity of the anchor.

It is a further object of the present invention to provide an anchor, in which a sleeve is secured to a pressure bearing plate and is of sufficient length to positively retain the steel tension members running therethrough in predetermined spacial relationship with the body of the anchor.

It is a further object of the present invention to provide an anchor, in which a supporting force being transmitted from a pressure bearing plate may be positively received by a hardened material filled within a sleeve secured to the pressure bearing plate and thereafter to an anchor body.

It is a still further object of the present invention to provide an anchor wherein the supporting load is transmitted through the steel tension members to a single pressure bearing plate to which is secured a mortar filled sleeve which in turn receives and transmits the supporting load to the anchor body.

These and other objects and advantages will become apparent from the following description taken together with the accompanying drawings in which.

DESCRIPTION OF THE PREFERRED EMBODIMENTS

Figure 1:
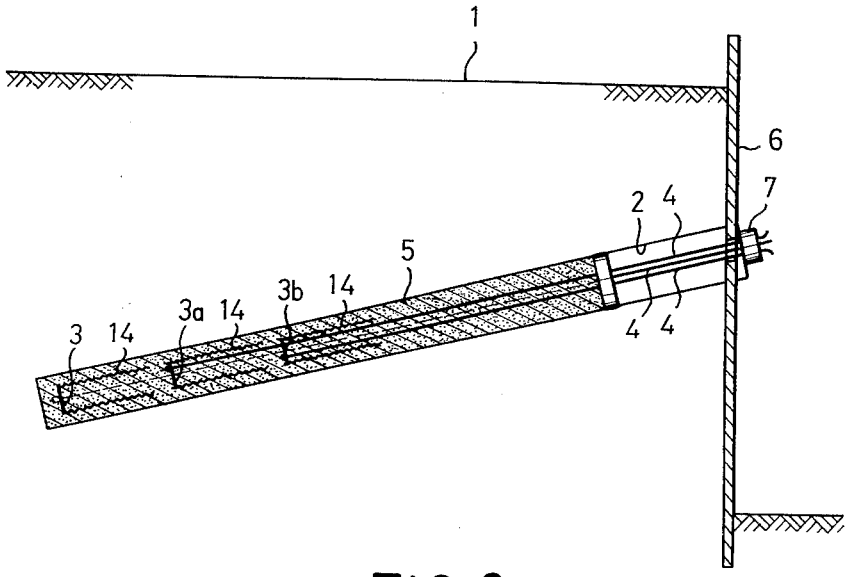
FIG. 1 is a sectional view in elevation of the anchor according to the present invention shown supporting an earth retaining wall.

Referring to FIG. 1, a bore of a diameter of from four to six inches and a length of from ten to one hundred feet is prepared in a section of earth 1 by means well understood by those skilled in the art. A steel tension member 4, having a pressure bearing plate 3 secured to the bore interior end of the member 4, is inserted in the bore thus prepared. Thereafter, a hardenable material such as cement mortar, cement paste, concrete or the like is injected into the bore 2 to provide an anchor body 5 therein.

The exterior end of the steel tension member 4 protrudes beyond the bore 2 for connection with a fastening means 7 secured to the surface of an earth retaining wall 6.

Figure 6:
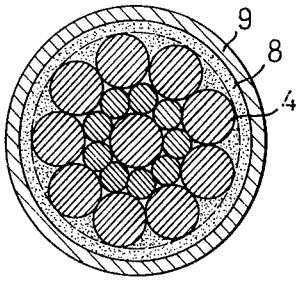
FIG. 6 is a cross-sectional view of a steel tension member.
Figure 7:
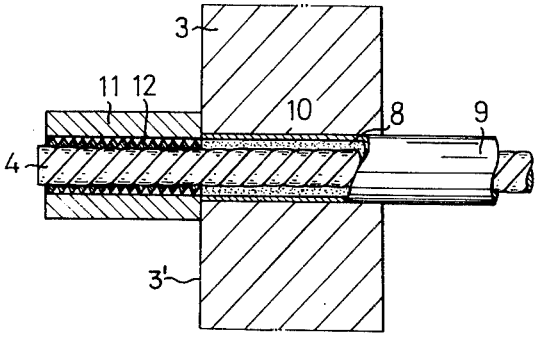
FIG. 7 is a fragmentary sectional view of the assembly of a pressure bearing plate, a steel tension member and a gripping sleeve.

As shown in FIG. 6, a preferred embodiment of the steel tension member 4 is provided in the form of a steel wire rope, which slidingly extends through a sheath 9. A lubricant, such as grease 8', is applied to the periphery of the wire so that the steel tension member 4 is maintained in bond-free condition relative to the anchor body 5. A pressure bearing plate 3, FIG. 7, is provided in the form of a circular steel plate or disc having its circumference provided with a plurality of cuts or notches, and having a diameter somewhat smaller than that of the bore 2. As shown in FIG. 7, the disc 3 is provided with a small hole 10, through which is inserted the steel tension member 4 retained in the sheath 9. The interior end portion of the steel tension member 4 is secured to a gripping sleeve 11 abutting the rear surface 3' of the pressure bearing plate 3.

As further shown in FIG. 7, the gripping sleeve 11 is fitted on the interior end portion of the steel tension member 4, with an interlocking coil 12 of triangular cross-section sandwiched in an annular space defined between the gripping sleeve 11 and the steel tension member 4, after which the gripping sleeve 11 is compressed into rigid engagement with steel tension member 4. In place of the interlocking coil 12, adhesives such as carborundum, or high strength synthetic resin, such as epoxy resin, may be used. The coil 12 is wound around the steel tension member 4, the gripping sleeve is then placed over the coil, and finally the gripping sleeve is compressed about the coil 12.

The gripping force of the gripping sleeve 11 is set to yield at approximately 85% of the yielding load of the steel tension member 4.

The maximum gripping yielding force may be varied by suitably selecting the lengths of the gripping sleeve 11 and interlocking coil 12. By way of example, assume an interlocking coil, having an equilateral triangular cross-section and a width of 1.1 mm, is wound 35 to 36 times around the periphery of the interior end portion of a steel strand wire having a diameter of 17.8 mm and a yield strength of 33600 kg/cm$^2$, with a steel gripping sleeve 11 having an outer diameter of 40.0 mm, an inner diameter of 21.5 mm and a length of 32 mm compressed to an inner diameter of 15 mm and coupled with the aforesaid interlocking coil, then there may be obtained a maximum gripping force of 28000 to 29000 kg/cm$^2$.

Figure 2:
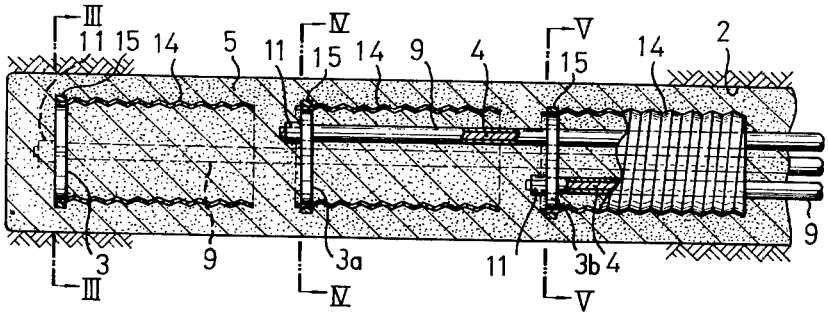
FIG. 2 is a fragmentary sectional view of the earth bore interior end of the anchor according to the present invention.
Figure 3:
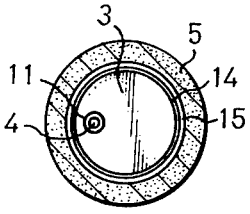
FIG. 3 is a cross-sectional view taken along the line III—III of FIG. 2.
Figure 4:
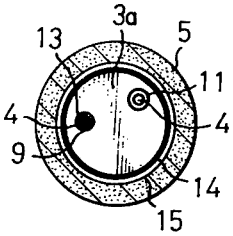
FIG. 4 is a cross-sectional view taken along the line IV—IV of FIG. 2.

With the anchor as shown in FIG. 2, a plurality of steel tension members 4 are so arranged that the respective interior ends of the steel members 4 are positioned at an equal spacing along the axis of the bore 2, with pressure bearing plates 3, 3*a* and 3*b* being secured to the respective aforesaid ends of the steel members 4 by means of the gripping sleeves 11 for rigid connection, sufficient to permit the respective pressure bearing plates 3, 3*a* and 3*b* to sustain the supporting forces transmitted from the steel tension members 4. See FIGS. 3, 4 and 5.

Figure 5:
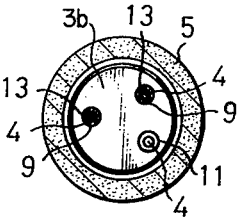
FIG. 5 is a cross-sectional view taken along the line V—V of FIG. 2.

In addition, there is defined a hole 13, see FIG. 5, in pressure bearing plate 3*b* so as to allow the passage of the steel tension members 4 and corresponding sheaths 9 therethrough for connection with bearing plates 3 and 3*a* respectively.

Steel sleeves 14 having inner diameters approximately the same as the outer diameters of the respective pressure bearing plates 3, 3*a* and 3*b* are secured to the respective pressure bearing plates by means of a suitable fastening means such as bands 15. The steel sleeve 14 may be corrugated in contour so as to be rigidly encased within the surrounding hardenable material. The sleeve 14 reinforces the anchor body 5 to withstand the forces being transmitted from the pressure bearing plate 3.

Figure 8:
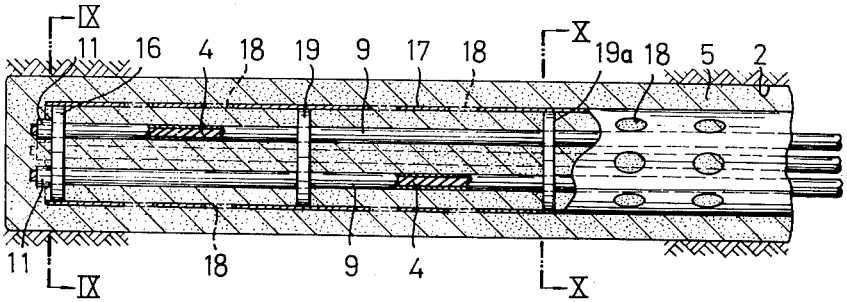
FIG. 8 is a fragmentary sectional view of a part of another embodiment of the anchor according to the present invention.
Figure 9:
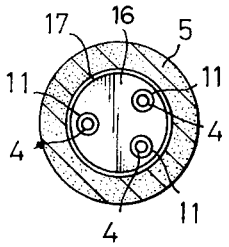
FIG. 9 is a cross-sectional view taken along the line IX—IX of FIG. 8.
Figure 10:
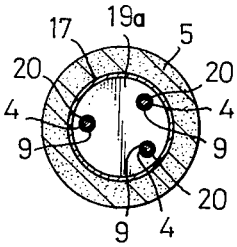
FIG. 10 is a cross-sectional view taken along the line X—X of FIG. 8.

In the anchor shown in FIG. 8, a single pressure bearing plate 16 is secured to the respective interior ends of a plurality of steel tension members 4, with the aid of gripping sleeves 11. In addition, a steel sleeve 17 approximately 6 to 13 feet long is secured to the peripheries of the pressure bearing plates 16, 19 and 19*a* in surrounding relation thereto. The sleeve 17 is formed with a corrugated periphery and which is provided with inlets 18, through which a hardenable material makes ingress into the sleeve 17. In addition, at least one pressure bearing plate 19*a* is secured to the steel tension members outboard of the pressure bearing plate 16 at a given spacing one from another. In this respect, the steel tension member 4, as well as sheaths 9, may be inserted through holes 20 defined in the pressure bearing plate or plates 19*a*.

Accordingly, when the steel tension members 4 are inserted into the bore 2, the members 4 may be supported by the pressure bearing plates 19 and 19*a* so as to extend therethrough without permitting bending.

Figure 11:
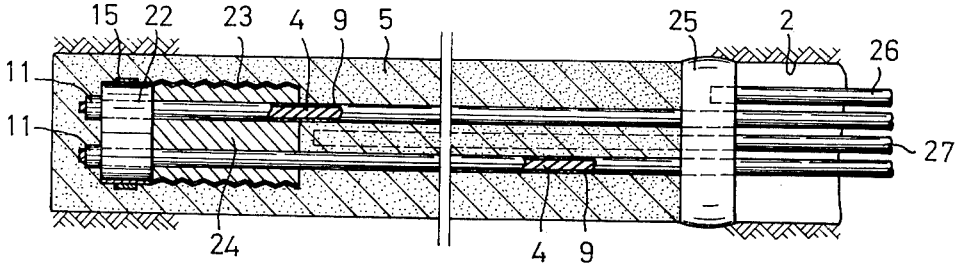
FIG. 11 is a fragmentary sectional view of a part of still another embodiment of the anchor according to the present invention.

With an anchor as shown in FIG. 11, a single pressure bearing plate 22 is integrally secured to the respective interior ends of a plurality of steel tension members 4 with the aid of gripping sleeves 11. In addition, high strength mortar 24 such as resin mortar, fiber concrete or the like is filled within a sleeve 23 having a corrugated periphery and secured to the pressure bearing plate 22. The high strength mortar 24 may be prefilled and hardened within the sleeve 23 before being inserted into the bore 2. Thus, the sleeve 23 may be molded in a plant so as to provide prefabricated through-holes therein for receiving steel tension members 4 as well as sheaths 9. The sleeve is then transported to a construction site for insertion of steel tension members 4 through the aforesaid through-holes. The pressure bearing plates are then secured to the members 4 with the aid of the gripping sleeves 11. A plug 25 is formed by causing expansion of grout after the steel tension members 4 have been inserted into the bore 2, the aforesaid grout being charged through an injection pipe 26 into the bore 2. Thus, the plug 25 may partition or close the bore 2, while a hardenable material may be injected under pressure through an injection pipe 27 into the bore 2.

Figure 12:
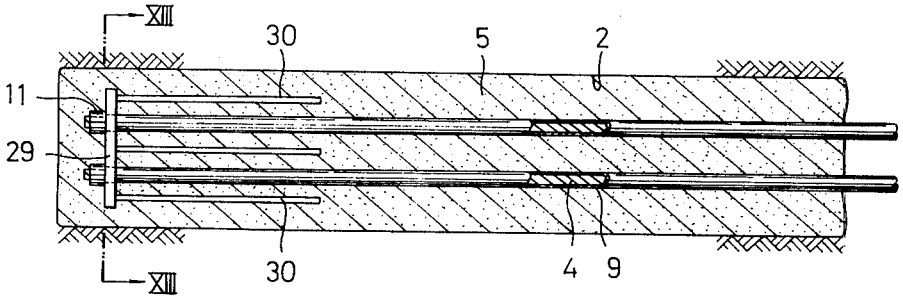
FIG. 12 is a fragmentary sectional view of a part of yet another embodiment of the anchor according to the present invention; and, FIG. 13 is a cross-sectional view taken along the line XIII—XIII of FIG. 12.
Figure 13:
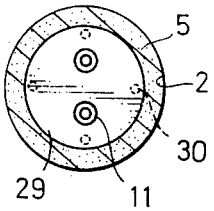

FIG. 12 shows supporting members 30 in the form of rods, providing a high pressure resisting strength. The supporting members 30 may be provided in the form of an irregular-shaped reinforcing steel rod and secured to the pressure bearing plate in a manner to extend away from the pressure bearing plate toward the entrance to the bore.

When the anchor thus described is no longer required, and the steel tension members 4 are to be removed, the outboard or exterior ends of the steel tension members 4 are pulled by means of a jack with a tension greater than the maximum retaining force of the gripping sleeves 11 to release the steel tension members from their sleeves. Then, the steel tension members 4 may then be withdrawn from the gripping sleeves 11, through sheaths 9. The steel tension members 4 thus withdrawn may be reused. Although the anchor body 5, pressure bearing plates 3, 16, 22 and sleeves 14, 17, 23 are normally abandoned within the bore, they may be readily broken or retrieved at a more convenient time.

The foregoing description of preferred embodiments of the invention are presented hereinfor illustrative purposes only and are not intended to unduly limit the scope of the invention.

Having thus defined the invention, it is claimed as follows:

1. For use in an earth bore, an earth anchor to be placed in said earth bore comprising: a steel tension member; a pressure bearing plate secured to one end of said steel tension member by means of a gripping sleeve non-rotatably secured to and encasing said one end and adapted to be linearly disengaged therefrom when a linear force exceeding a predetermined linear gripping force of said sleeve is applied to said steel tension member; a sheath encasing said steel tension member; and a hollow cylindrical interlocking means concentrically placed between said one end of said steel tension member and said gripping sleeve, said interlocking means being adapted to fail in shear when said linear force is applied to said steel tension member.

2. The earth anchor set forth in claim 1, wherein said interlocking means comprises an adhesive material.

3. The earth anchor as set forth in claim 1, wherein said interlocking means consists of a cylindrical wire coil spring having a triangular cross section.

4. For use in an earth bore, an earth anchor comprising a plurality of steel tension members of graduated lengths wherein the interior end portions of said steel tension members are staggered along the length of said anchor; a pressure bearing plate secured to said end portion of each said steel tension member by means of a gripping sleeve encasing said end portion and adapted to be disengaged therefrom when a force exceeding a predetermined gripping force is applied thereto; and a sheath encasing each of said steel tension members.

5. The earth anchor set forth in claim 2, wherein said steel tension members, said pressure bearing plates and said gripping sleeves are encased in a hardenable cementitious substance.

6. The earth anchor set forth in claim 2, wherein said steel tension members, said pressure bearing plates and said gripping sleeves are encased in a hardenable cementitious substance when placed in said earth bore.

7. For use in an earth bore, an earth anchor to be placed in said earth bore comprising: a steel tension member; a pressure bearing plate secured to one end of said steel tension member by means of a gripping sleeve non-rotatably secured to and encasing said one end and adapted to be linearly disengaged therefrom when a linear force exceeding a predetermined linear gripping force of said sleeve is applied to said steel tension member; a sheath encasing said steel tension member; and a plurality of rods secured to the side of said pressure bearing plate opposite from the gripping sleeve side to protrude normally therefrom.

8. For use in an earth bore, a earth anchor comprising a plurality of steel tension members of equal length; a single pressure plate secured to the interior end portions of said steel tension members by means of gripping sleeves non-rotatably secured to and encasing the said end portions of said steel tension members and adapted to be linearly disengaged therefrom when linear forces exceeding predetermined linear gripping forces of said sleeves are applied to said steel tension members; a sheath encasing each of said steel tension members; and interlocking means concentrically placed between said ends of said steel tension members and said gripping sleeves, said interlocking means being adapted to fail in shear when said linear forces are applied to said tension members.

9. The earth anchor set forth in claim 8, wherein said interlocking means comprises a cylindrical wire coil spring, the cross section of said wire being at least three sided with an intersection of two sides being aligned radially outwardly from the center of said wire to engage the interior surface of said sleeve.

10. The earth anchor set forth in claim 8, wherein said interlocking means comprises an adhesive substance.

11. The method of constructing an earth anchor comprising the steps of:

threading a steel tension member through a center hole in a pressure bearing plate;

positioning said pressure bearing plate adjacent one end of said steel tension member;

placing a sleeve over said one end of said steel tension member to abut against one side of said pressure bearing plate;

securing said sleeve to said steel tension member with means adapted to fail in shear upon the application of a predetermined linear force between said sleeve and said steel tension member;

encasing said steel tension member in a second sleeve;

packing said second sleeve with a lubricant;

boring a hole in the earth;

lowering the pressure bearing plate end of said steel tension member into said hole;

securing the opposite end of said steel tension member to a retaining wall; and filling said hole with a hardenable cementitious substance.

12. The method set forth in claim 11, including the additional steps of:

preparing a plurality of different length steel tension members with pressure bearing plates, passing the longer steel tension members through preformed holes in the pressure bearing plates of the shorter steel tension members;

securing the ends of said steel tension members with sleeves adjacent their respective pressure bearing plates;

adapting said sleeves to yield to a predetermined linear force between said sleeves and said steel tension members;

encasing said steel tension members in second sleeves;

packing said second sleeves with a lubricant;

lowering the pressure bearing plate ends of said steel tension members in said holes; and securing the opposite ends of said steel tension members to said retaining wall.

* * * * *